United States Patent [19]

Silliman

[11] Patent Number: 5,054,153

[45] Date of Patent: Oct. 8, 1991

[54] GOLF CLUB CLEANER

[76] Inventor: Paul D. Silliman, 6801 Deerwood La., Maple Grove, Minn. 55369

[21] Appl. No.: 444,326

[22] Filed: Dec. 1, 1989

[51] Int. Cl.[5] ..... A46B 9/02

[52] U.S. Cl. ..... 15/160; 15/143 R; 273/32 B; D4/124; D21/234

[58] Field of Search ..... 15/104.94, 160, 191 R, 15/192, 193, 159 R, 209 R, 222, 143 R; D4/124, 130, 116, 127, 128, 137; D21/234, 205; 273/32 R, 32 B, 346

[56] References Cited

U.S. PATENT DOCUMENTS

| | | | |
|---|---|---|---|
| D. 150,218 | 7/1948 | Fournier | D4/116 |
| D. 166,447 | 4/1952 | Conover . | |
| D. 275,780 | 10/1984 | Pearson . | |
| D. 280,229 | 8/1985 | Parent . | |
| D. 292,753 | 11/1987 | Clayton et al. . | |
| 977,789 | 12/1910 | Donovan | 15/191 R |
| 1,710,816 | 4/1929 | Evans . | |
| 2,672,640 | 3/1954 | Peterson et al. | 15/193 |
| 2,840,842 | 7/1958 | Kaheny . | |
| 2,945,250 | 7/1960 | Worthington | 15/104.94 |
| 3,641,610 | 2/1972 | Lewis | 15/159 R |

FOREIGN PATENT DOCUMENTS

| | | | |
|---|---|---|---|
| 604069 | 6/1935 | Fed. Rep. of Germany | 15/159 R |
| 495686 | 11/1938 | United Kingdom | 15/159 R |
| 1489751 | 10/1977 | United Kingdom | 273/346 |

OTHER PUBLICATIONS

Playthings, published by Mego Corp., Jan. 1977, p. 13.
Playthings, published by Golden Crown Enterprises, Feb. 1977, p. 146.

*Primary Examiner*—Harvey C. Hornsby
*Assistant Examiner*—Mark Spisich
*Attorney, Agent, or Firm*—Paul L. Sjoquist

[57] ABSTRACT

The present invention relates to devices for cleaning golf clubs and, more particularly, to a spherical device that has a circumferential band of bristles.

8 Claims, 1 Drawing Sheet

GOLF CLUB CLEANER

BACKGROUND OF THE INVENTION

The present invention relates to devices for cleaning golf clubs and, more particularly, to such a device that may be easily carried while playing the game, conveniently used to clean a club and then easily cleaned itself in a ball cleaning device such as those typically found scattered around a golf course.

During a round of golf, a club face repeatedly comes into contact with the grass and soil on a golf course and naturally the club face becomes dirty, layered with a buildup of grass and/or soil. Therefore, it would be desirable for a golfer to carry a device for cleaning the face of clubs during a round of golf.

An ideal cleaning device would be small enough to be easily carried in a golf bag along with extra balls, tees, etc., and yet be effective to remove debris from the grooves on the face of a club. Such cleaners are disclosed in U.S. Pat. Nos. Des. 275,780, Des. 292,753 and Des. 280,229.

Naturally, as these golf club cleaners and the like are used, there is a transfer of the debris removed from the face of the club to the cleaning device itself. Thus, it would be helpful if the cleaning device could be cleaned periodically during a round of golf. A convenient way to do this would be to use the golf ball cleaning devices which commonly are found scattered around a golf course. These ball cleaning devices generally take the form of a paddle-like structure with an aperture in it into which a golf ball is placed. The paddle is then inserted into a container lined with bristles and filled with soapy water. The paddle with the ball inserted is moved up and down in the container; the bristles and the soapy water contact the ball and debris is removed therefrom. It would be most convenient if this type of ball cleaning device could be used to clean the golf club cleaner as well.

Prior art cleaning devices may not be able to be cleaned thoroughly in a typical ball cleaning device. For example, the golfer's brush disclosed in U.S. Pat. No. Des. 292,753 is too elongated to fit within a typical ball cleaner. Similarly, the cleaner disclosed in U.S. Pat. No. Des. 275,780 appears to have a flat bottom face which may cause the cleaning device to assume and stay in a particular position in a typical ball cleaner and therefore, not be thoroughly cleaned.

SUMMARY OF THE INVENTION

An object of the present invention is to provide an easily carried golf club cleaning device which itself may be cleaned conveniently during a game of golf.

Another object of the present invention is to provide a golf club cleaning device that may be securely gripped by the person using the device.

Still another object of the present invention is to provide a golf club cleaning device having an effective cleaning or working surface area large enough so that the device is effective in use.

In accordance with these objects, a golf club cleaning device with a spherical body approximately the size of a golf ball is provided. The exterior surface of the spherical body is embossed with random dimples of the type found on golf balls to give the device the appearance of a golf ball and to facilitate holding the device while in use. The spherical body of the cleaning device is also provided with a bristle surface which is affixed about a circumference of the spherical body. Because the body is approximately equal to the size of a typical golf ball, the device may be inserted into a standard golf ball cleaner and be cleaned of dirt or other debris.

Advantages of the present invention are that it is easily carried by a golfer during the golf game, it is effective in cleaning the face of a golf club, including the grooves thereon, while a game is taking place and that it may be easily cleaned during the course of the game.

Other objects and advantages of the present invention will be understood with reference to the following specification and appended drawings and claims.

DETAILED DESCRIPTION OF THE INVENTION

Figure 1:
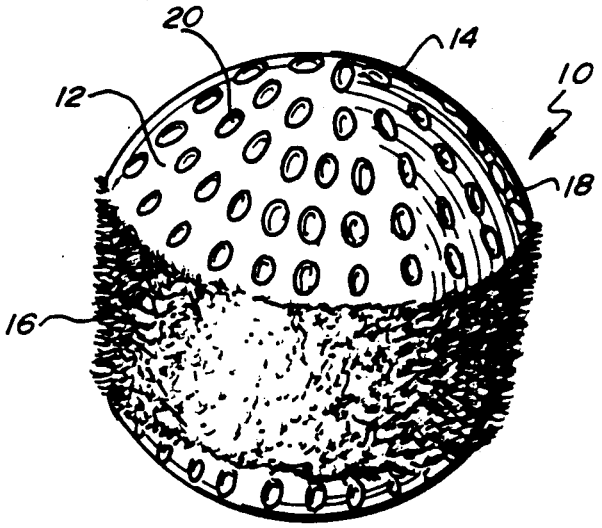
FIG. 1 is a perspective view of the golf club cleaner.

FIG. 1 shows a perspective view of the present invention, a golf club cleaner 10. The cleaner 10 has spherical body 12. The exterior surface 14 of body 12 includes a bristle surface 16 and a generally smooth surface 18. Smooth surface 18 may be embossed or impregnated with random dimples 20 of the type which are found on golf balls. The bristle surface 16 is affixed about a circumference of the body 12. The body 12 may be formed of suitable plastic or other material.

Figure 2:
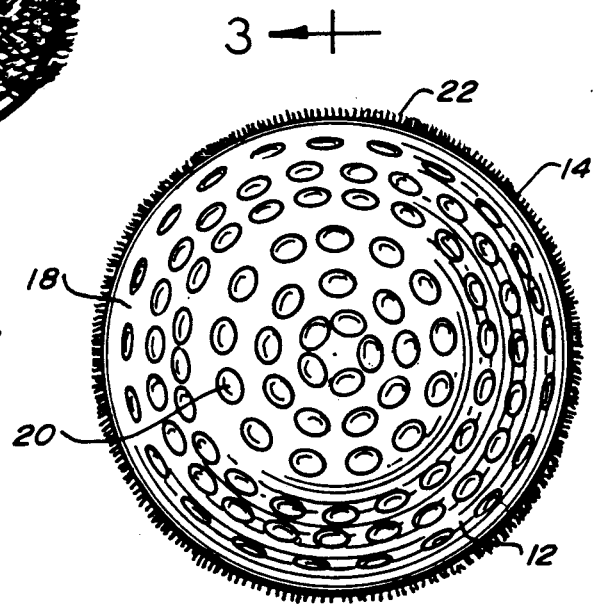
FIG. 2 is a side elevational view of the golf club cleaner.

FIG. 2 shows a side elevational view of body 12 and, specifically, the generally smooth portion 18 of the body 12 having the dimples 20 thereon. The dimples 20 are provided to enable a user to have a secure grip on the cleaner 10 body 12 while the cleaner is being used to remove grass or soil from the face of a golf club (not shown).

Figure 3:
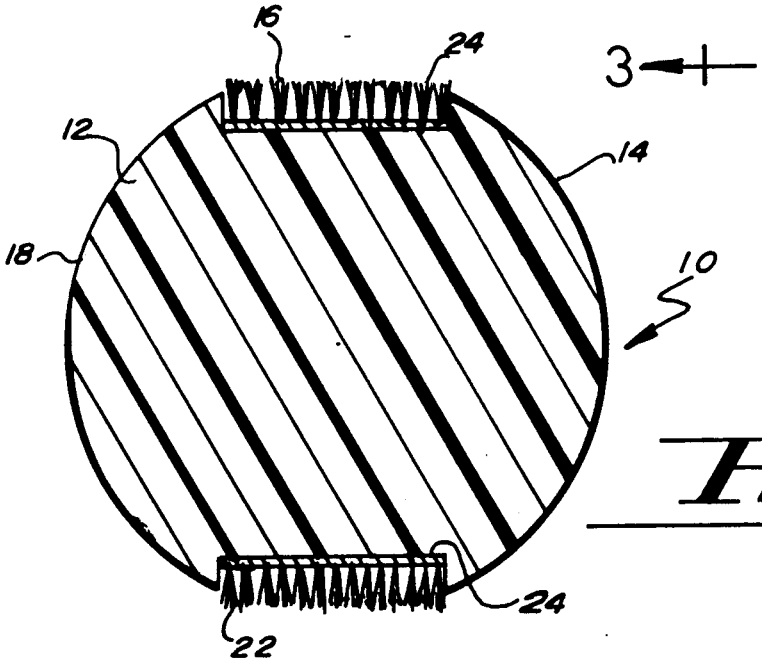
FIG. 3 is a cross-sectional view taken along the line 3—3 of FIG. 2.

FIG. 3 is a cross-sectional view and shows that the bristle surface 16 is provided about a circumference of generally spherical body 12. The bristle surface 16 is generally coextensive with the exterior surface 14 of the body 12, but as seen in FIG. 2, the bristle material may extend slightly beyond the exterior surface 14. A bristle material 22 is attached to a base 24 which in turn is attached to the body 12 of the cleaner 10. The base 24 may be attached to the body 10 by conventional gluing or mechanical techniques.

The cleaning device 10 is approximately equal to the size of a standard golf ball, that is, it has a diameter of 1.68 inches. Thus, the device may be inserted into a standard golf ball cleaner typically found scattered about golf courses so that it, including the bristle surface, may be cleaned of dirt or other matter removed from the face of a club. Because the cleaner 10 of the present invention has a generally spherical body 12, including the bristle surface 16 which is circumferenced about the spherical body 12, it will not jam a typical ball cleaning device and it will rotate freely just as a golf ball does so that dirt or other material may be cleaned from all about the spherical body 12, including the circumferential bristle surface area 16.

Because bristle surfaces 16 is a circumferential band about the spherical body 12 of the club cleaner 10 of the present invention, when that circumferential bristle surface 16 is aligned with the grooves on the face of a club, a user may rotate the device 10 as it is being used thereby presenting a clean area of bristle surface 16 while cleaning any one club face. Further, the dimpled surface area 18 of the cleaning device 10 of the present invention enables a user to maintain a secure grip on the cleaner 10 while scrubbing a club face.

The present invention may be embodied in other specific forms without departing from the spirit or attributes thereof, and it is therefore desired that the present embodiment be considered in all respects as illustrative and not restrictive, reference being made to the appended claims rather than to the foregoing description to indicate the scope of the invention.

What is claimed:

1. A golf club cleaner for conveniently cleaning a face of a golf club during a game of golf, the cleaner comprising a spherical body having an exterior surface, said surface having two portions, a relatively large and dimpled surface portion whereby the user grips the cleaner during use, a circumferential groove about said spherical body, and a relative smaller and rougher surface portion for scouring the face of a golf club, said rougher surface comprising a circumferential band of bristles embedded in a base which is affixed in said circumferential groove, said bristles extending at least slightly beyond said dimpled surface.

2. The golf club cleaner of claim 1, wherein said band of bristles have an outer surface generally coextensive with the exterior surface of said body.

3. The golf club cleaner of claim 1, wherein the size of said spherical body is approximately equal to the size of a standard golf ball.

4. The golf club cleaner of claim 3, wherein the spherical body has a diameter of 1.68 inches.

5. A golf club cleaner for conveniently cleaning the face of a golf club during a game of golf, the cleaner comprising a generally spherical body having an exterior surface, said surface having two differing surface characteristics, a first surface characteristic being generally smooth having slight dimples embossed therein and a second surface characteristic being relatively rough, having outwardly extending bristles for scouring the face of a golf club, a circumferential groove, extending to a predetermined depth, about said spherical body, said rough surface further comprising a circumferential band of bristles, said band of bristles having an outer surface extending at least slightly beyond the exterior surface of said spherical body, said bristles being affixed to a circumferential base having a diameter which is less than the diameter of said spherical body, said base being affixed about the depth of said circumferential groove.

6. The golf club cleaner of claim 5, wherein said bristles are adhesively attached to said base which is adhesively attached to said spherical body.

7. The golf club cleaner of claim 5, wherein the size of said cleaner is equal to the size of a golf ball so that the cleaner may be cleaned in a standard golf ball cleaner.

8. A golf club cleaner for cleaning a face of a golf club, comprising a spherical body having a dimpled exterior surface, with a circumferential groove formed about said body; and a circumferential band of bristle material filling said circumferential groove, said bristle material extending at least slightly beyond said dimpled surface, said bristle material being affixed to a base, and said base being affixed in said circumferential groove.

* * * * *